US007854351B2

(12) United States Patent
Bougamont

(10) Patent No.: US 7,854,351 B2
(45) Date of Patent: Dec. 21, 2010

(54) INTERCALATED LOCKING RING

(75) Inventor: Jean-Louis Bougamont, Eu (FR)

(73) Assignee: Rexam Dispensing Systems S.A.S. (FR)

( * ) Notice: Subject to any disclaimer, the term of this patent is extended or adjusted under 35 U.S.C. 154(b) by 378 days.

(21) Appl. No.: 12/048,845

(22) Filed: Mar. 14, 2008

(65) Prior Publication Data

US 2008/0217359 A1 Sep. 11, 2008

Related U.S. Application Data

(63) Continuation of application No. PCT/FR2005/050755, filed on Sep. 16, 2005.

(51) Int. Cl.
*B67D 5/00* (2006.01)

(52) U.S. Cl. ..... 222/153.13; 222/321.7; 222/384

(58) Field of Classification Search ..... 222/153.13, 222/402.11, 321.1, 321.7, 321.8, 321.9, 383.1, 222/383.3, 385, 384
See application file for complete search history.

(56) References Cited

U.S. PATENT DOCUMENTS 5,524,793 A * 6/1996 O'Neill ..... 222/153.13
5,615,806 A * 4/1997 Grothoff ..... 222/153.13
5,899,363 A * 5/1999 Bliss et al. ..... 222/153.02
6,065,647 A * 5/2000 Bliss et al. ..... 222/153.02
6,193,112 B1 * 2/2001 Santagiuliana ..... 222/153.13
6,672,486 B2 * 1/2004 Santagiuliana ..... 222/207
6,695,171 B2 * 2/2004 Walters et al. ..... 222/153.13
7,357,278 B2 * 4/2008 Mira Navarro ..... 222/153.04

* cited by examiner

*Primary Examiner*—Kevin P Shaver
*Assistant Examiner*—Donnell Long
(74) *Attorney, Agent, or Firm*—St. Onge Steward Johnston & Reens LLC

(57) ABSTRACT

The invention concerns a device for locking an axially mobile actuating and freely rotating head of a pump whereof the body is mounted on the neck of a reservoir of liquid product via a connecting socket. The invention is characterized in that it comprises an intercalated ring mounted on top of the pump body and whereof the inner side wall is provided with at least one longitudinal guiding groove capable of receiving, through rotation of the head, at least one rib bone by an inner coaxial sleeve integral with the head.

15 Claims, 2 Drawing Sheets

INTERCALATED LOCKING RING

CROSS-REFERENCE TO RELATED APPLICATIONS

The present application is a continuation of pending International patent application PCT/FR2005/050755 filed on Sep. 16, 2005 which designates the United States.

FIELD OF THE INVENTION

The present invention concerns a device for locking the actuation head of a pump for a liquid product dispenser.

BACKGROUND OF THE INVENTION

More precisely, the invention relates to an axially mobile and rotationally free actuation head that is intended to be mounted on the pump jet.

These heads form pushbuttons or diffusers for liquid products, provided with an ejection aperture and equipped, if applicable, with a spray nozzle found in particular in cosmetic, pharmaceutical or perfumery applications.

Traditional dispensers are provided with a pump whereof the body is mounted in the neck of a reservoir of liquid product by means of a connecting element such as a socket which is screwed, crimped or snapped onto the neck, gripping the upper part of the pump body in a sealed manner.

In certain cases, it is desirable to provide means enabling locking of the pump actuation head in a closure position, for sealing reasons, avoiding in particular possible leakages of product during transport, or for safety, perhaps even tamper-resistance, reasons.

Generally these locking means are arranged under the head at the upper part of the pump connecting element, being produced directly and in a single piece with this element.

With certain types of pump, it can be advantageous to assemble their body from above on the connecting element.

However, the traditional connecting element prevents such mounting since its upper part is partially closed by the locking means and an opening of larger diameter would lead to a disproportionate increase in the dimensions of the head.

Furthermore, from an industrial point of view, the connecting element is a complex component and it is necessary to use separate production lines to produce respectively connecting elements with locking means and those that lack them.

Moreover, the locking means must be oriented angularly according to the position of the ejection aperture of the head which is restricting for assembly on account of their fixed linking with the connecting element.

SUMMARY OF THE INVENTION

The present invention aims to solve these technical problems satisfactorily.

This aim is achieved according to the invention by means of a device comprising an intercalary ring topping the pump body and whereof the internal side wall is provided with at least one longitudinal guide groove capable of receiving, through rotation of the head, at least one rib carried by an internal coaxial sleeve fixed to said head.

According to an advantageous characteristic, said intercalary ring comprises a lower skirt closely fitting the upper part of the pump body and on which anti-rotation internal serrations are arranged.

Preferably, said serrations become embedded in the wall of the pump body or in part of the connecting socket.

According to another characteristic, said intercalary ring comprises, in the upper part, at least one notch for supporting the sleeve of said head in the high position.

According to a specific variant, said notch has a guiding flat section delimited, on one side, by a limit stop and, on the other side, by a boss adjacent to said groove.

According to yet another characteristic, the upper rim of the ring has, in line with the guide groove, a flat raised portion extended by at least one adjacent concave portion.

Furthermore, the external side wall of the ring is provided with radial fins allowing its gripping and indexing at mounting.

According to a specific variant, the lower edge of the ring rests against an internal shoulder formed on a socket for connecting the pump body to the reservoir.

Preferably, said shoulder is extended radially by a central collar of limited diameter in which the pump body is fitted.

According to another variant, provision is made that the upper part of said socket delimits, with the facing part of said ring, a cylindrical space in which the side wall of the head moves.

The locking device according to the invention makes it possible to use only one single connecting element and to keep the same actuation head, irrespective of the embodiment chosen.

This is because it is sufficient to add the intercalary ring in order to change from an embodiment without locking to an embodiment with locking and this operation is performed very easily without it being necessary to dismantle the pump or the connecting element.

Moreover, the method of assembling the pump is simplified since its body is introduced into the connecting element from above and is suitable for various types of pump.

BRIEF DESCRIPTION OF THE DRAWINGS

Other objects and advantages of the invention will emerge during the following description, given with reference to the accompanying drawings, in which.

DETAILED DESCRIPTION OF THE INVENTION

The device depicted in the figures is intended to provide the temporary locking of a head T allowing the actuation of a pump P which is mounted on and, at least partially, in the neck of a reservoir R of liquid product.

The head T is here also provided with a duct and an ejection aperture e for the product (see FIGS. 3B and 3C) which is, in the case of a spray, provided with a diffusion nozzle.

Figure 1:
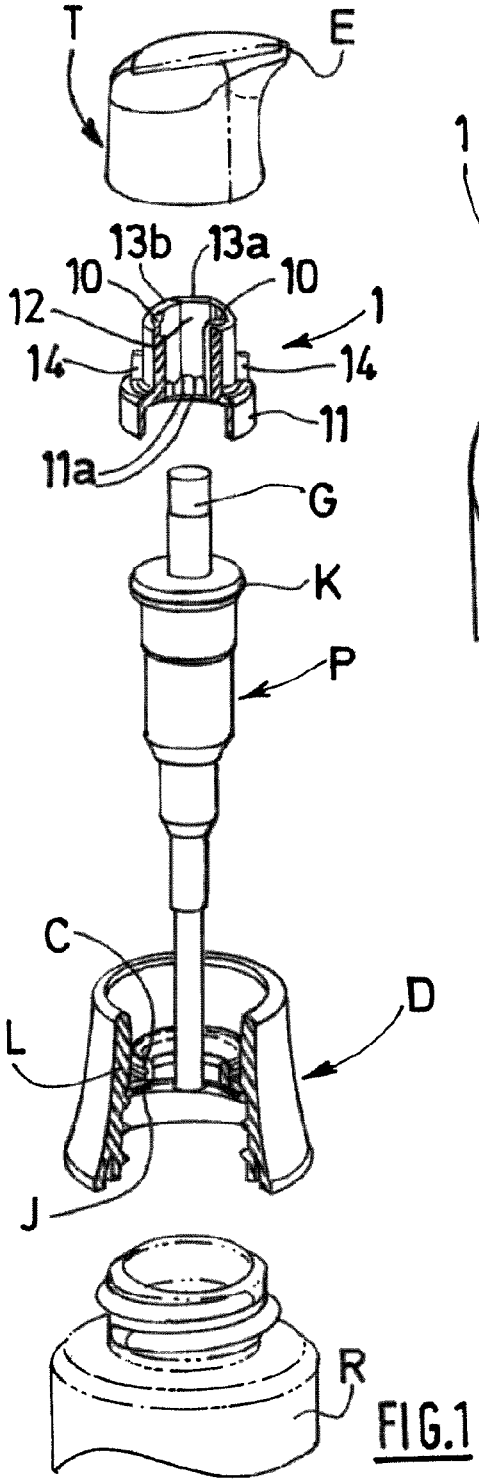
FIG. 1 depicts an exploded perspective view of the upper part of a dispenser equipped with a locking ring according to one embodiment of the invention.
Figure 3C:
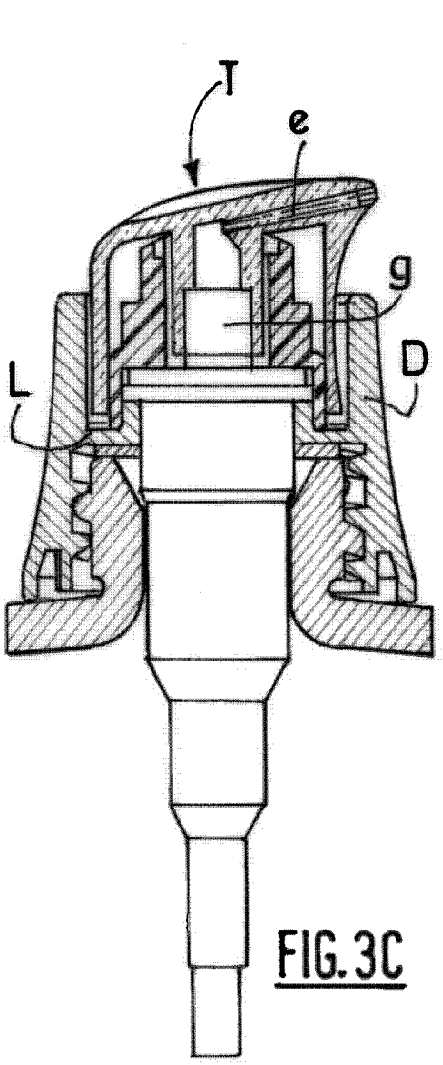
FIGS. 3A to 3C depict sectional views of the dispenser of FIG. 1 respectively in the rest and locked position of the head, in the unlocked rest position of said head and in the delivery position.
Figure 3B:
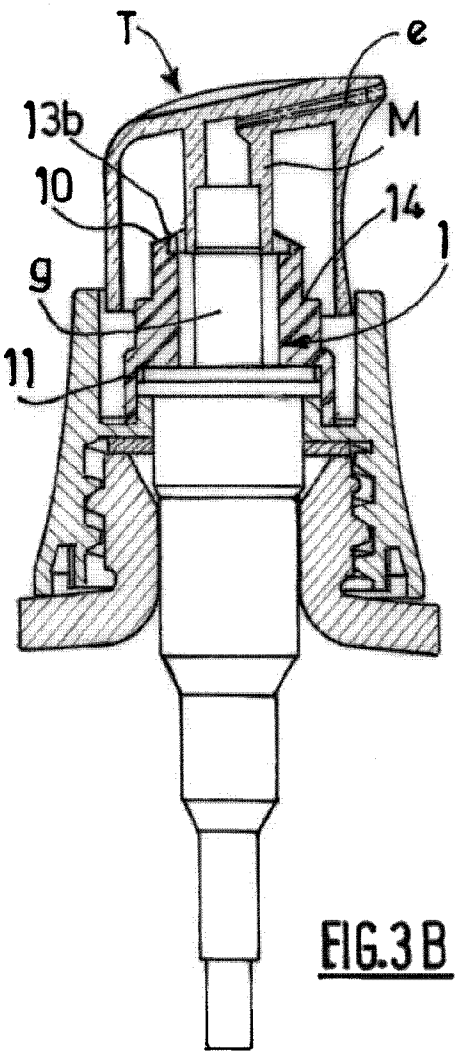
Figure 3A:
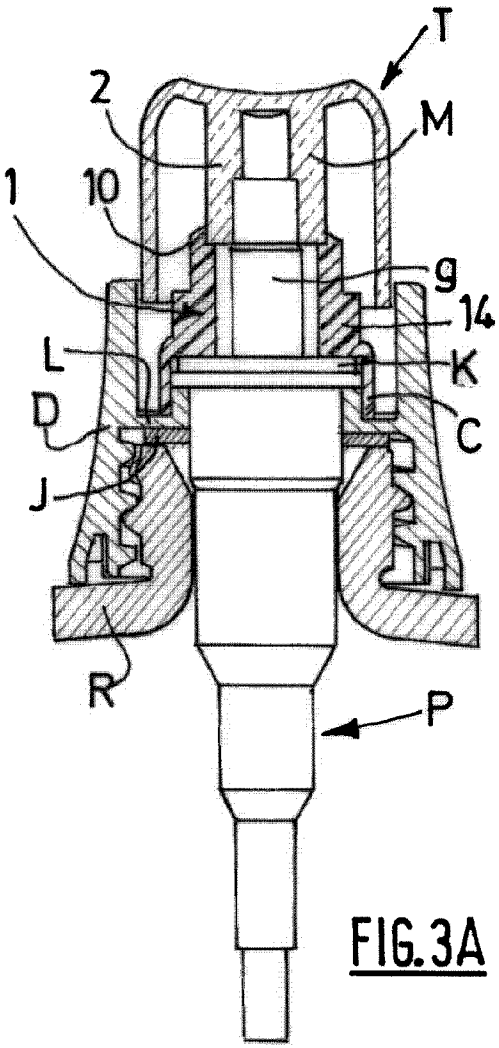

The mounting of the pump P is performed by means of a connecting socket D capable of being screwed, as in FIGS. 1 and 3A, or else snapped onto the neck, gripping a seal J.

The socket D is extended radially by an internal shoulder L and a central collar C of limited diameter in which the cylindrical body of the pump P is fitted.

The pump P generally has an upper flange K which comes to rest on the edge of the collar C.

The head T is generally fitted onto the nozzle tube g of the pump P which protrudes upwards outside the reservoir R via a coaxial internal sleeve M which has a section with a restriction in order to limit the pushing in of the tube g.

With a view to the delivery of the product under pressure, the head is subjected to axial manual pressing which brings about its descent with the tube g (FIG. 3C).

As for the tube g, this is fixed to an internal piston (not depicted) housed in the pump body and cooperating with a return spring (not depicted) so that the tube g has a rotational freedom which is communicated to the head T.

Thus, the head and the tube g can turn together freely by 180° around the axis of the dispenser.

In order to remove the risks of accidental pressing on the head T and avoid an uncontrolled escape of product, for example during transport of the dispenser, provision is made, according to the invention, to equip the dispenser with a locking device.

This device comprises an add-on ring 1 mounted around and at a distance from the tube g and intercalated between the pump body and said head T as depicted in FIG. 1.

This ring 1, which is a component independent of the socket D, is produced, for example, by moulding.

As depicted in FIG. 1, the ring 1 comprises a lower skirt 11 which comes to top the pump body, closely fitting its upper part with radial clamping.

On the skirt 11, anti-rotation internal serrations 11*a* are arranged, which become embedded in the wall of the pump body and more particularly on the circumference of the flange K or else in the central collar C of the socket D in order to immobilise the ring in relation to the head T/tube g assembly (see FIG. 1).

To that end, it will be ensured that the constituent material of the flange or of the collar C is less rigid than that of the serrations 11*a*.

The external side wall of the ring 1 is provided with radial fins 14 allowing its gripping and indexing at mounting.

So as to have two positions, respectively of locking (FIG. 3A) and of release (FIG. 3B), the ring 1 is provided, on its internal side wall, with at least one, and preferably two, longitudinal guide grooves 12 diametrically opposite and capable of receiving, through rotation of the head T, at least one, and preferably two, corresponding ribs 2, carried by the internal coaxial sleeve M fixed to said head.

The position of the ribs 2 is determined according to the shape of the reservoir and the position of the ejection aperture e on the head T.

Figure 2A:
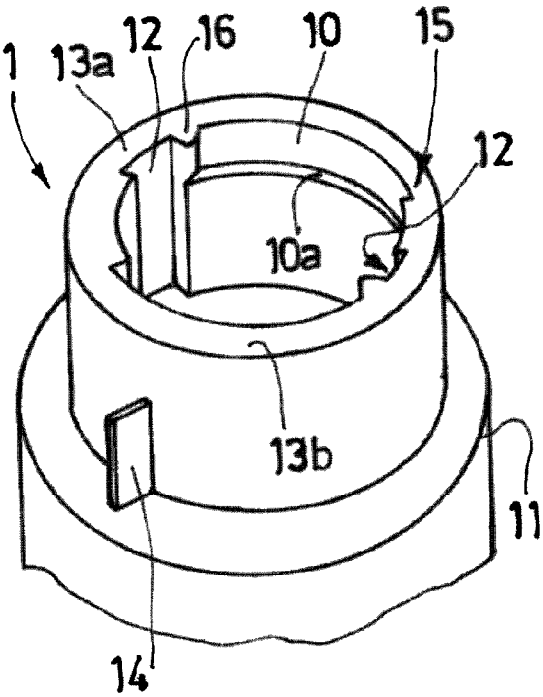
FIGS. 2A and 2B depict perspective views respectively from above of a variant embodiment of the ring of the invention and from below of an actuation head, adapted to the embodiment of FIG. 1 of the device of the invention.
Figure 2B:
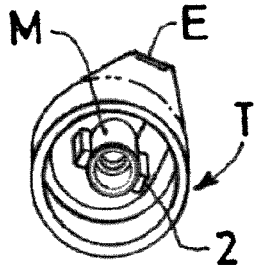

In the embodiment depicted in FIGS. 2B, 3A and 3B, the ribs 2 extend in a diametral plane situated at 90° from the plane containing the ejection aperture e.

The ring 1 comprises, in the upper part, at least one, and preferably two, internal notches 10 for supporting the sleeve M of said head in the high position, as depicted in FIG. 2A. These notches allow the head to be maintained in the locking position and define a flat section 10*a* which, during rotation of the head, provides guidance of the lower edge of the ribs 2 to the unlocking position.

In the embodiment depicted, the notches 10 are delimited, on one side, by a limit stop 15 and, on the other side, by a boss 16 adjacent to one of the grooves 12.

During the change from the locking position to the unlocking position, the ribs 2 deform elastically on contact with the boss 16 which can itself deform, producing a click, in order to allow it to be passed over and their alignment with the groove 12.

The upper circumference of the ring has, in line with the guide groove, a flat raised portion 13*a* being extended, on either side, by two concave portions 13*b* surmounting the notches 10.

The two flat portions 13*a* have an angular length corresponding substantially to the width of the grooves 12.

In the unlocking position of FIG. 3B, the return of the tube g to the high position by the spring of the pump piston still maintains the head in the high position and the ejection aperture e is oriented in the direction required for dispensing of the product.

Delivery of the product is obtained by pressing the head T and its downward travel is guided by sliding of the ribs 2 in the grooves 12 as depicted in FIG. 3C.

During this movement, the side wall of the head sinks into the cylindrical space delimited between the internal wall of the socket D and the facing wall of the ring 1.

At the end of travel of the head, the volume of product delivered corresponds to one measure.

Releasing the pressing on the head leads to rising of the tube g with the head and the operator then has only to turn the latter by 90° to put it back in the locking position.

What is claimed is:

1. A device for locking an axially mobile and rotationally free actuation head of a pump whereof a body is mounted in the neck of a reservoir of liquid product by means of a connecting socket, wherein it comprises an intercalary ring topping a pump body and whereof an internal side wall is provided with at least one longitudinal guide groove capable of receiving, through rotation of the head, at least one rib carried by an internal coaxial sleeve fixed to said head, wherein said intercalary ring comprises a lower skirt closely fitting the upper part of the pump body and on which anti-rotation internal serrations are arranged.

2. The device according to claim 1, wherein said serrations become embedded in the wall of the pump body or in part of the connecting socket.

3. The device according to claim 1, wherein said intercalary ring comprises, in the upper part, at least one notch for supporting the internal coaxial sleeve of said head in the high position.

4. The device according to claim 3, wherein said notch has a guiding flat section delimited, on one side, by a limit stop and, on the other side, by a boss adjacent to said groove.

5. The device according to claim 1, wherein the upper rim of the ring has, in line with the guide groove, a flat raised portion extended by at least one adjacent concave portion.

6. The device according to claim 1, wherein the external side wall of said ring is provided with radial fins allowing its gripping and indexing at mounting.

7. The device according to claim 1, wherein the lower edge of the ring rests against an internal shoulder formed on the socket for connecting the pump body to the reservoir.

8. The device according to claim 7, wherein said shoulder of the connecting socket is extended radially by a central collar of limited diameter in which the pump body is fitted.

9. The device according to claim 6, wherein the upper part of said socket delimits, with a facing part of said ring, a cylindrical space in which the side wall of the head moves.

10. The device according to claim 7, wherein the upper part of said socket delimits, with a facing part of said ring, a cylindrical space in which the side wall of the head moves.

11. A device for locking an axially mobile and rotationally free actuation head of a pump whereof a body is mounted in the neck of a reservoir of liquid product by means of a connecting socket, wherein it comprises an intercalary ring topping a pump body and whereof an internal side wall is provided with at least one longitudinal guide groove capable of receiving, through rotation of the head, at least one rib carried by an internal coaxial sleeve fixed to said head, wherein the external side wall of said ring is provided with radial fins allowing its gripping and indexing at mounting.

12. The device according to claim 11, wherein the upper part of said socket delimits, with a facing part of said ring, a cylindrical space in which the side wall of the head moves.

13. A device for locking an axially mobile and rotationally free actuation head of a pump whereof a body is mounted in the neck of a reservoir of liquid product by means of a connecting socket, wherein it comprises an intercalary ring topping a pump body and whereof an internal side wall is provided with at least one longitudinal guide groove capable of receiving, through rotation of the head, at least one rib carried by an internal coaxial sleeve fixed to said head, wherein the lower edge of the ring rests against an internal shoulder formed on the socket for connecting the pump body to the reservoir.

14. The device according to claim 13, wherein said shoulder of the connecting socket is extended radially by a central collar of limited diameter in which the pump body is fitted.

15. The device according to claim 13, wherein the upper part of said socket delimits, with a facing part of said ring, a cylindrical space in which the side wall of the head moves.

* * * * *